United States Patent [19]

Green et al.

[11] Patent Number: 4,928,800

[45] Date of Patent: May 29, 1990

[54] STEERING HANDLE FOR LUGGAGE CASE

[75] Inventors: Stephen T. Green, Oxford, England; Willibald Van Hoye, Zwijnaarde, Belgium

[73] Assignee: Samsonite Corporation, Denver, Colo.

[21] Appl. No.: 866,200

[22] PCT Filed: Sep. 6, 1985

[86] PCT No.: PCT/GB85/00399

§ 371 Date: May 5, 1986

§ 102(e) Date: May 5, 1986

[87] PCT Pub. No.: WO86/01384

PCT Pub. Date: Mar. 13, 1986

[30] Foreign Application Priority Data

Sep. 6, 1984 [EP] European Pat. Off. ..... 84306083.1

[51] Int. Cl.[5] ..... A45C 13/00

[52] U.S. Cl. ..... 190/115; 190/18 A

[58] Field of Search ..... 190/115, 18 A, 39; 16/115; 280/47.37 R; 150/107, 108

[56] References Cited

U.S. PATENT DOCUMENTS

| | | | |
|---|---|---|---|
| 2,364,073 | 12/1944 | Howard | 220/94 |
| 3,447,195 | 6/1969 | Bush | 190/115 X |
| 3,805,929 | 4/1974 | Kuwayama | 190/18 A |
| 3,948,365 | 4/1976 | Gregg et al. | 190/18 A |
| 4,358,006 | 11/1982 | Castelli | 190/18 A |
| 4,508,202 | 4/1985 | Siegert et al. | 190/115 |
| 4,544,050 | 10/1985 | Seynhaeve | 190/115 |

FOREIGN PATENT DOCUMENTS

| | | |
|---|---|---|
| 3246955 | 7/1983 | Fed. Rep. of Germany . |
| 11182 | of 1910 | United Kingdom . |
| 1600156 | 10/1981 | United Kingdom . |
| 2116948 | 10/1983 | United Kingdom . |

*Primary Examiner*—Bryon Gehman

*Attorney, Agent, or Firm*—Gregory W. O'Connor

[57] ABSTRACT

A luggage is provided with a steering handle (15) for steering the case when it is being rolled on the ground. The handle (15) is pivoted to the case shell (19) by means of a pivot pin (20) for movement between a closed position in which the handle (15) lies adjacent the shell (19) and an extended position in which the handle projects from the shell. Movement of the handle (15) away from the closed position is limited by means of a stay (23) connected between the case shell (19) and a position on the steering handle (15) spaced from the pivot pin (20) towards the free end of the handle (15). The stay (23) is of resilient flexible material. The base molding (17) of the handle is provided with a projection (32) which holds the stay (23) in a flexed condition when the handle (15) is in the closed position so that the stay (23) exerts a force on the handle tending to hold the handle (15) in the closed position. Thus, the need for a separate spring to hold the handle in the closed position is avoided.

8 Claims, 4 Drawing Sheets

STEERING HANDLE FOR LUGGAGE CASE

The present invention relates to a steering handle for a wheeled luggage case.

Luggage cases are known which have a pair of wheels at one corner on which the case may be rolled for ease of transport when the case is heavy. It is also known to provide a folding handle on the side of the case opposite the wheels for steering the case when it is being rolled. The handle is hinged to the wall of the case or to a mounting plate secured to the wall of the case. When not in use, the handle may be folded to lie flush against the case wall but when the case is to be rolled on the ground it can be swung out to provide a steering handle.

In some known constructions, the hinging movement of the handle is limited by a stop on the wall of the case immediately above the pivot point so that the handle is rigid in use and can bear some of the load of the case. A disadvantage of this arrangement is that a considerable load is placed on the pivot point and the stop by the weight of the case. It is desirable to be able to make steering handles of plastic but it has been found in practice that plastic handles are liable to be broken due to the weight that is placed upon them by the load in the case. The longer the handle the greater is the load on the pivot point and therefore it has only been possible hitherto to make plastic handles of short length.

It is also known to provide a metal steering handle with a metal stay connected between the handle and the mounting plate by means of which the handle is secured to the case wall. The stay limits the hinging movement of the handle and shares the load of the case with the pivot of the handle. A spring acts on the stay with an over centering action to hold the handle in the extended position, and also bias the handle towards the closed position when it has been pivoted towards the case by a certain distance.

The present invention provides a steering handle for a luggage case, with a stay in which the need for a separate spring is avoided.

According to the present invention there is provided a luggage case comprising a shell, steering handle for steering the case when it is being rolled on the ground, the steering handle being pivoted to the shell or mounting means secured to the shell for movement between a first closed position in which the handle lies adjacent the shell and a second extended position in which the handle projects from the shell, the movement of the handle away from the first position being limited at the second position by means of a stay connected on the one hand to the shell of the case and on the other hand to the steering handle at a position spaced from the pivot axis towards the free end of the handle, the stay being of resilient flexible material, means being provided for holding the stay in a flexed condition when the handle is in the first position so that the stay exerts a force on the handle tending to hold the handle in the first position. Thus the need for a separate spring to hold the handle in the closed position is avoided.

In a preferred embodiment of the invention the stay is free at one end and passes through a slot, the stay being drawn through the slot as the handle is moved from the first position to the second position, a stop on the free end of the stay engaging the edge of the slot when the handle is in the second position to prevent movement of the handle beyond the second position. An embodiment of the invention will now be described by way of example with reference to the accompanying drawings in which.

Figure 1:
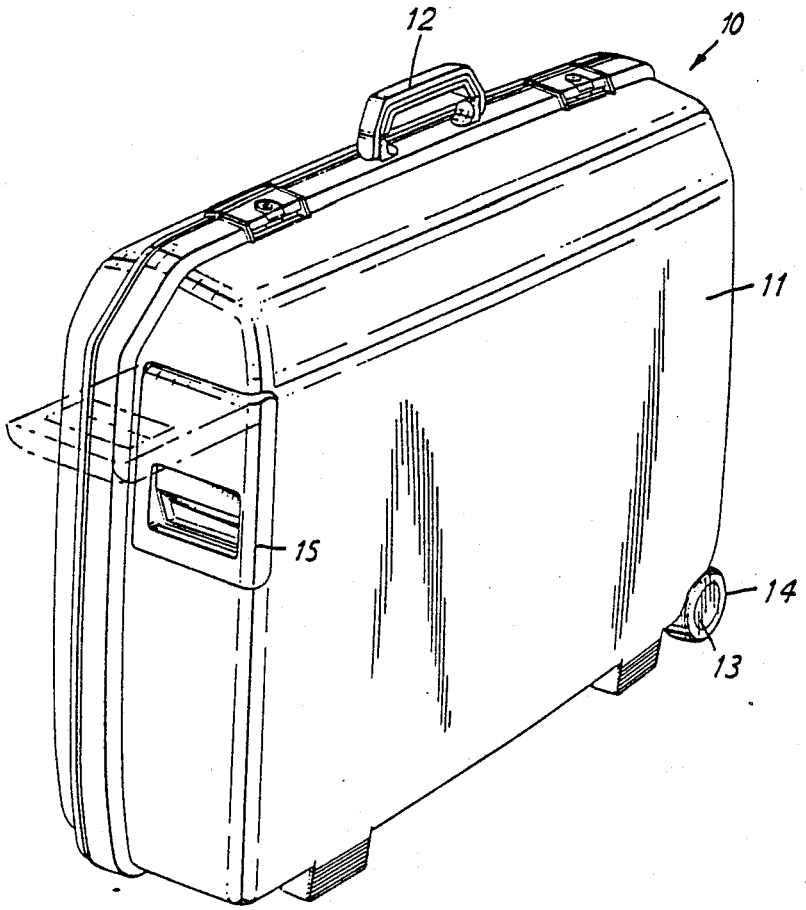
FIG. 1 shows a perspective view of a suitcase in accordance with the invention.
Figure 2:
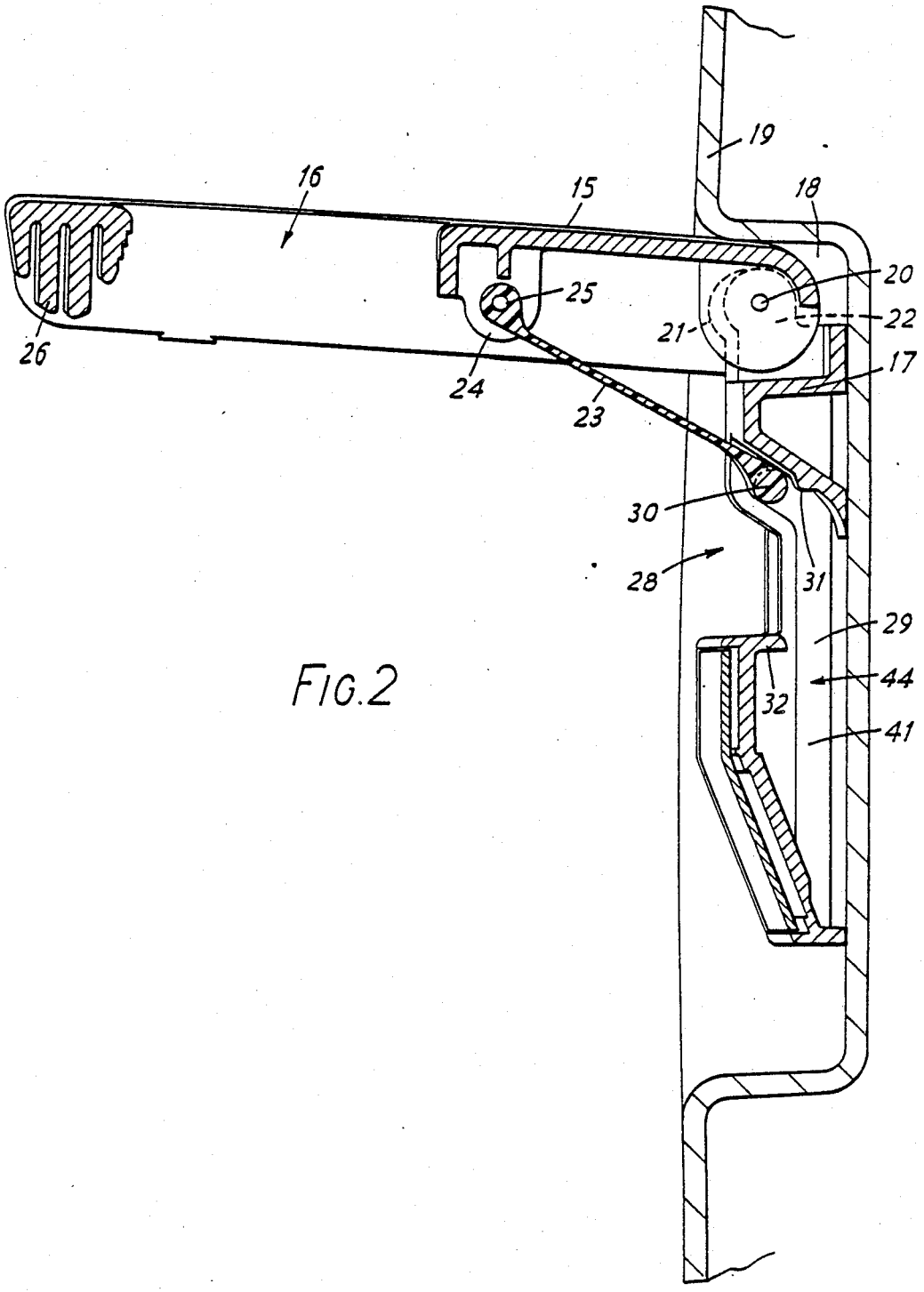
FIG. 2 shows a cross-section of the handle of the suitcase of FIG. 1 on an enlarged scale with the handle in the extended position.
Figure 3:
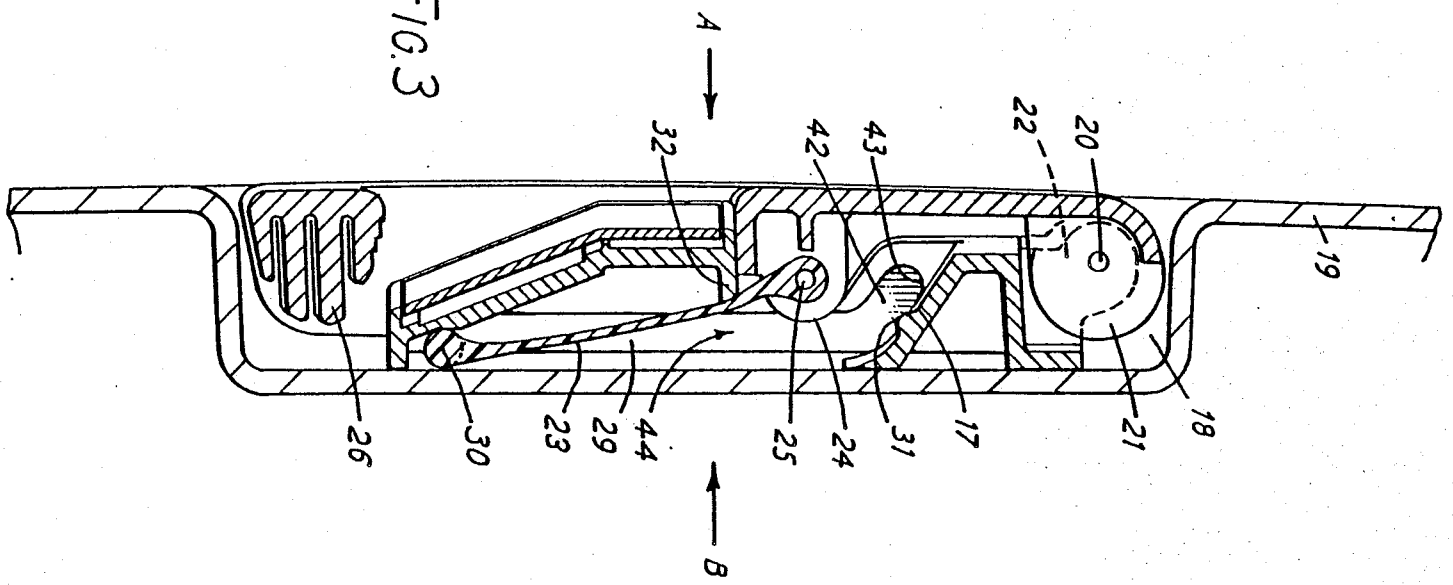
FIG. 3 shows a cross-section of the handle of FIG. 2 in the closed position.
Figure 4:
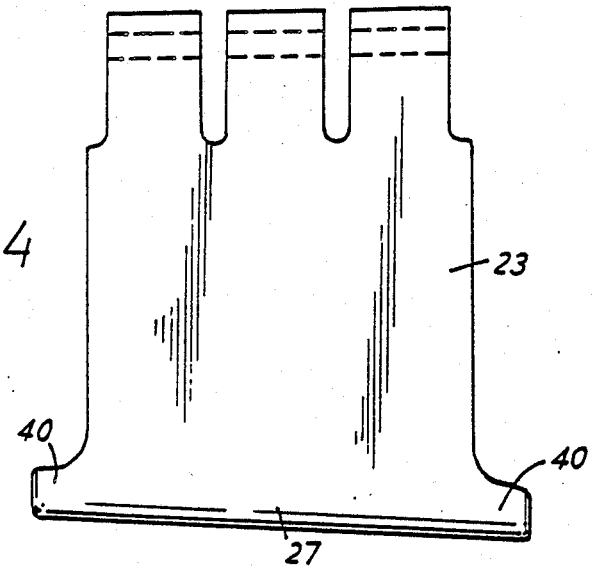
Figure 5:
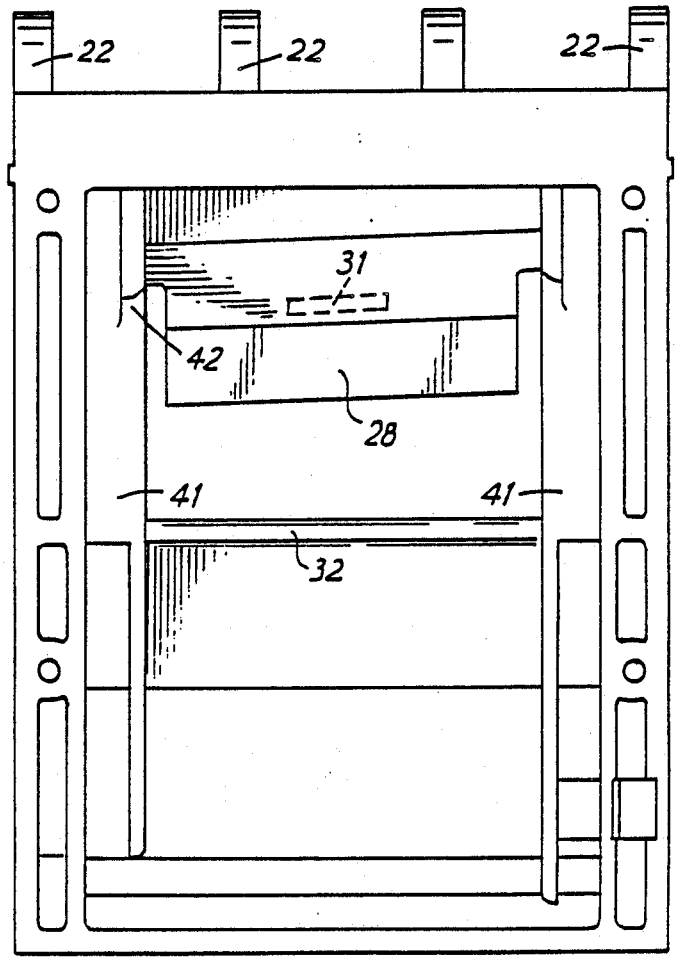

FIG. 4 shows an elevation of the stay of the handle of FIGS. 2 and 3 viewed in the direction of the arrow A in FIG. 3; and FIG. 5 shows an elevation of the base moulding of the handle assembly of FIGS. 2 and 3 viewed in the direction of the arrow B in FIG. 3. Referring to the drawings, a suitcase 10 comprises a shell 11 formed in two halves hinged together at their lower edge. A carrying handle 12 is mounted on the upper edge of the case. A pair of wheels 13 are mounted on the shell of the case in recesses at a lower corner 14 of the case. A steering handle 15 is pivotally connected to the shell of the case on the side opposite to the wheels 13. The handle is normally folded against the wall of the case when the case is being carried by the handle 12 or when the case is not in use. It can however be swung out into the position shown in broken lines to provide a steering handle for use when the case is being rolled on the wheels 13.

The steering handle 15 and the shell of the suitcase may be formed of any suitable materials, for example plastics. The handle has an opening 16 for receiving the fingers of the user to enable the handle to be gripped. A base moulding 17 is secured in a recess 18 in the wall 19 of the case shell for example by screws (not shown). The handle 15 is pivotally mounted to the moulding 17 by means of a pivot pin 20 which passes through lugs 21 on the handle and lugs 22 on the moulding. The handle 15 can swing about the pivot axis 20 between a first position shown in FIG. 3 in which it lies flush with the shell wall to a second position shown in FIG. 2 in which it extends away at a predetermined angle from the case shell.

A stay 23 is connected at one end to a lug 24 on the handle by means of a pivot pin 25. The lug is spaced from the pivot axis towards the free end 26 of the handle. The point of attachment of the stay intermediate the ends of the handle is selected as appropriate having regard to the length of the stay, the angle the stay is to make to the horizontal in the extended position and the load to be carried by the case. In one particular embodiment we have found a position spaced from the pivot by a distance of between one-third and two-thirds the length of the handle is appropriate.

The other end 27 of the stay is connected to the shell of the case by means of the base moulding 17. The end 27 of the stay passes through an opening 28 into a guide means comprising channel 29 in the moulding. As can be seen in FIG. 4, the stay is wider at its end 27 than elsewhere so as to provide two laterally projecting lugs 40 which are received in grooves 41 formed in the moulding 17 at the sides of the guide channel 29. The stay moves into and out of the channel 29 through the opening 28 and the lugs move down and up the grooves 41 as the handle is swung towards and away from the shell 19.

The grooves 41 run generally parallel to the wall of the case throughout most of their length but are curved away from the case at their upper ends 42. The grooves are closed at their upper extremities to form stops 43. The lugs 40 engage the stops 43 when the handle is in its second extended position shown in FIG. 2. This prevents further movement of the stay out of the guide channel and prevents the handle being moved beyond the second position.

A projection 31 is formed on the upper side of the channel 29 just behind the opening 28. The projection 31 projects partially into the path of the end of the stay as it moves along the grooves 41. It engages behind the enlarged end 27 of the stay 23 when the handle is in the extended position shown in FIG. 2 and prevents the weight on the handle on the stay pushing the stay into the channel. The stay 23 is sufficiently stiff to hold the handle in the extended position without the handle being supported by the user at its free end. The projection 31 is not however sufficient to prevent the enlarged portion 27 being squeezed past it when a downwards force is applied to the free end of the handle 26 by the user. The stay flexes slightly in the transverse direction to allow the enlarged end 27 to ride over the projection 31.

As can be seen in FIG. 3 the channel 29 is arranged to cause flexing of the stay 23 when the handle is in the folded position. The lugs 40 are guided in the groove 41 between the moulding 17 and the recess 18 in the wall of the case. A projection 32 extending from the lower edge of the opening 44 towards the back of the channel engages the front surface of the stay. The stay is bowed flexed or by the projection 32 towards the rear of the channel 29 when the handle is in the first or folded position. The projection 32 presses on the stay even before the handle is completely folded. This flexing of the stay causes a force to be applied by the stay to the handle at the pivot 25 urging the handle towards the case. Thus the flexing of the stay causes the handle to be urged into the closed position once the handle has been rotated a certain amount from the extended position and the handle will then close automatically when released. Once in the closed position the flexing resists movement of the handle away from the case.

It is to be noted that there is no stop to limit the movement of the handle away from the suitcase. When the handle is in the extended position, only the stay 23 prevents further pivoting of the handle about the pivot axis 20. Thus, when the case is lifted by means of the handle 15 for rolling on the wheels 13, the load of the case is transmitted to the handle through the pivot axis 20 and the stay 23. In this way the load of the case is shared and the forces on the pivot point are reduced compared with previous designs. This reduction in the force on the pivot point renders the handle less liable to be broken in use.

The handle assembly consists only of the base moulding, the handle, the stay and the pivot pins. There is no additional spring required to bias the handle into the closed position.

Although in the embodiment described the guide for the stay and the pivot for the handle are provided in mounting means separate from the case wall itself it will be appreciated that they could be provided in the case wall itself.

Although the invention has been described in relation to a case with wheels, the invention is applicable to cases with other ground engaging means for supporting the case on the ground, such as casters or rollers.

We claim:

1. A luggage case comprising a shell, a steering handle for steering the case when it is being rolled on the ground, means for pivotally mounting the steering handle for pivotal movement between a first closed position in which the handle lies adjacent the shell and a second extended position in which the handle projects at a predetermined angle from the shell, the pivotal movement of the handle being limited at the second position by means of a stay connected at one end to the steering handle at a position spaced from the means for pivotally mounting towards the free end of the handle and at the other end to the shell, the stay being of resilient flexible material, and means for holding the stay in a flexed condition when the handle is in the first position whereby, when in said flexed condition, said stay exerts a force on the handle tending to hold the handle in the first position.

2. A case according to claim 1 further comprising guide means, said one end of the stay is movable in said guide means such that said one end of the stay moves along the guide means as the handle is moved from the first position to the second position, and a stop means on the end of the stay for engaging a stop means on said guide means when the handle is in the second position to prevent movement of the handle beyond said predetermined angle at the second position.

3. A case according to claim 2 characterized in that the guide means is on the shell of the case, or on mounting means secured to the shell.

4. A case as set forth in claim 1, wherein said means for holding comprises means for guiding an end of said stay and deflecting means for engaging the stay intermediate its ends when the handle is in the first position to bow the stay towards the shell.

5. A case according to claims 2, 3, or 4 characterised in that the means for guiding comprise grooves which receive lugs on said other end of said stay.

6. A case according to any of claims 2, 3, or 4 further including means for resisting movement of the stay from the second position towards the first position when the handle is in the second position.

7. A case according to claim 6 characterised in that the means comprise an abutment secured to the case which engages an abutment on the stay when the stay is in the second position.

8. A case according to claim 7 characterised in that the abutment on the stay is provided by said other end of the stay and the abutment on the case is provided by a projection which projects partially into the path of said other end of the stay as it is guided by the guide means, the end of the stay riding over the projection upon application of a force to the handle.

* * * * *